US006109952A

United States Patent [19]

Jaag

[11] Patent Number: 6,109,952

[45] Date of Patent: Aug. 29, 2000

[54] TERMINAL CONNECTOR ASSEMBLY

[75] Inventor: Dieter Jaag, Villingen-Schwenningen, Germany

[73] Assignee: Ria Electronic Albert Metz, Germany

[21] Appl. No.: 09/058,918

[22] Filed: Apr. 13, 1998

[30] Foreign Application Priority Data

Jan. 28, 1998 [DE] Germany ..... 198 03 085

[51] Int. Cl.[7] ..... H01R 4/24

[52] U.S. Cl. ..... 439/441; 439/224; 439/855; 439/907

[58] Field of Search ..... 439/717, 441, 439/715, 907, 682, 686, 855, 222, 224

[56] References Cited

U.S. PATENT DOCUMENTS

| | | | |
|---|---|---|---|
| 3,474,383 | 10/1969 | Mahon et al. | 439/717 |
| 4,133,990 | 1/1979 | Wanner et al. | 439/441 |
| 4,239,324 | 12/1980 | Stenz | 439/717 |
| 4,653,842 | 3/1987 | Kirma | 439/717 |
| 5,853,304 | 12/1998 | Landreau et al. | 439/721 |

FOREIGN PATENT DOCUMENTS

| | | |
|---|---|---|
| 0735616A2 | 10/1996 | European Pat. Off. . |
| 4210020A1 | 3/1992 | Germany . |
| 4336965 A1 | 10/1993 | Germany . |
| 9402 699 U | 2/1994 | Germany . |
| 9420097 U1 | 12/1994 | Germany . |
| 29606347 U1 | 4/1996 | Germany . |

*Primary Examiner*—Neil Abrams
*Assistant Examiner*—Eugene G. Byrd
*Attorney, Agent, or Firm*—Eugene E. Renz, Jr., P.C.

[57] ABSTRACT

A terminal connector comprising a housing (10), a contact element (30), in the housing, said contact element having at least one clamped connection for connecting a conductor (50), and at least one connecting contact formed on the contact element, said contact element (30) being a one-piece member and having edges shaped to form springs (32, 33*a*, 33*b*, 36*a*, and 36*b*) for at least one clamped connection and at least one connecting contact, and means mounting the contact element (30) in a positive, form-locking manner in the housing (10).

16 Claims, 6 Drawing Sheets

TERMINAL CONNECTOR ASSEMBLY

BACKGROUND OF THE INVENTION

Single or multipin terminal connectors of the type to which the present invention relates are commonly used to connect one or more conductors. Accordingly, the terminal connector assembly usually has for each pin to be connected, a clamped connection for the conductor which is connected in a conductive manner via a contact element to at least one connecting contact. The connecting contact is the vehicle for connecting the terminal connector to a device to which the conductor is to be associated. For example, a terminal connector is mounted on a circuit board wherein the conductive pathways are connected to the connecting contacts of the terminal connector.

There are various types of clamp connections for the presently known terminal connectors. For example, there are screw-type terminal contacts, installation displacement contacts and spring-type terminal contacts. The connecting contacts in these known assemblies can be designed as plug-type contacts, solder contacts or the like. Presently known terminal connector designs are technically relatively easy to produce and to assemble since assembly is usually associated with a permanent, predetermined orientation of the clamp connections and the connecting contacts. Specifically, this means the terminal connector can be inserted and connected only with the orientation permanently predetermined by the arrangement of the clamp connections and the connecting contacts. This technique has certain disadvantages and drawbacks. For example, a separate type of terminal connector is therefore required for each different concrete application. In the case of the convention terminal connectors; however, a greater degree of versatility is associated with a more complicated design which in turn means higher production and assembly costs.

SUMMARY OF THE INVENTION

With the foregoing in mind, it is an object of the present invention to provide a terminal connector assembly characterized by novel features of construction and arrangement which can be produced and assembled very economically at low cost and which provides a high degree of versatility with respect to orientation and use. To this end, the assembly comprises a contact element made of a one-piece stamping of sheet material of a predetermined shape to form springs for at least one clamped connection and at least one connecting contact and means mounting the contact element in a positive form locking manner in the housing. More specifically, the goal of the present invention is to provide a terminal connector wherein each pin to be connected consists of a contact element which can be stamped as one piece out of sheet metal. Predetermined sections of the edges of the stamped metal part are then bent upward to form springs both for the clamp connections for the conductors and also for the connecting contacts. By this construction, the contact element can be inserted loosely and supported in the housing in a positive form locking manner.

The contact elements are extremely easy to manufacture because only a stamping and bending procedure is required in the formation of the complete contact element including both the clamped connection and the connecting contact. Further, the assembly of the terminal connector is also greatly simplified because the only step necessary is to insert the contact element loosely in the housing of the terminal connector. It as been found that in accordance with the present invention, the production and assembly of the terminal connector are particularly suitable for high speed automated assembly procedures.

Because the clamped connections and connecting contacts can be bent upward around the entire periphery of the stamped metal part forming the contact element, there is great freedom in terms of the number and arrangement of the clamped connections and connecting contacts, a freedom which can be exploited without leading to an increase in production and assembly costs. By distributing several clamped connections and connecting contacts around the periphery of the contact element and by arranging them in different plug-in directions, great flexibility is obtained with respect to the orientation of the terminal connector. The same type of terminal connector can thus be used for different applications. Production costs can therefore be lowered as a result of high-volume production, and inventory costs can be reduced because of the smaller number of different types which must be kept in stock.

There are additional specific features of the invention which provide certain functional and manufacturing advantages. For example, in accordance with one embodiment of the present invention, the terminal connector is constructed from individual modules, each of which represents one pin to be connected. This produces a cost reduction, since only one standard module is produced and terminal connectors with any desired number of pins can be assembled from the modules.

In accordance with another feature of the present invention, the housing of each module consists of a housing plate and a housing frame which are of a configuration to form a receptacle cavity for receiving the contact element and where the configuration is such to hold the contact element in a positive, form-locking manner. The open side of the frame of the module is sealed off by either the housing plate of the adjacent module or by a cover.

In accordance with another feature of the present invention, the clamp connection preferably have a clamping spring designed like a barb to ensure a simple and reliable connection of the conductors to the clamp connection. When the stripped conductor is pushed in, the clamping spring can be easily pushed aside. However, because the edge of the free end of the clamping spring penetrates the conductor, the spring prevents the conductor from being pulled back out. A slide piece supported in the housing permits release of the clamp connection when it is desired to remove the conductor.

BRIEF DESCRIPTION OF THE DRAWINGS

These and other objects of the present invention and various features and details of the operation and construction thereof are hereinafter more fully set forth with reference to the accompanying drawings, wherein.

DETAILED DESCRIPTION OF THE PREFERRED EMBODIMENT

Figure 1:
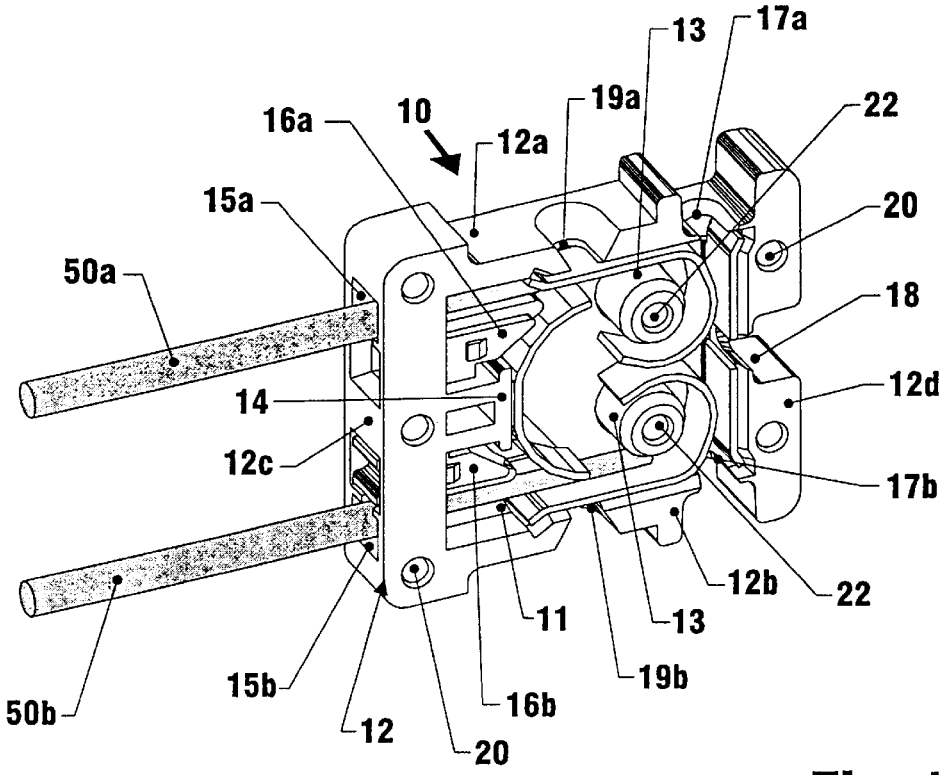
FIG. 1 is a perspective view of a first embodiment of a module of the terminal connector.

There are various embodiments of the present invention illustrated and described herein and for sack of simplicity, the parts which are the same in each embodiment are designated by the same reference numerals and are explained only once in conjunction with the first exemplary embodiment of the present invention which is illustrated in FIGS. 1–8, inclusive.

Referring now to the drawings, there is shown in FIGS. 1–8, inclusive, a first embodiment of connector assembly in accordance with the present invention. The terminal connector assembly consists of a plurality of individual modules, each of which holds one of the pins to be connected. Thus the terminal connector assembly can be designed as a single pin connector or as a multi-pin connector with any desired number of pins.

Considering now the terminal connector assembly more specifically, and with respect to FIG. 1, there is shown an individual module M comprising a flat, essentially rectangular box-like housing 10 including a flat essentially rectangular housing plate 11 and a housing frame 12 projecting peripherally beyond the housing plate 11. Housing plate 11 and housing frame 12 may be molded from plastic as a single unitary piece. Housing frame 12 extends all the way around the periphery of housing plate 11 and comprises first and second slide ways 12*a*, 12*b*, and front and rear end wall 12*c* and 12*d*, respectively. By this arrangement, the housing 10 forms a receptacle C which is enclosed by housing plate 11 and housing frame 12 and which is open on the side of the frame opposite housing plate 11.

Positioning pegs 13 project from the interior surface of housing plate 11 as at 11*a*. The height H of pegs 13 looking in a direction perpendicular to the housing plate 13 is generally the same as the height H1 of housing frame 12. A support surface 14 is formed at the center of end wall 12*c* which projects into the interior of housing 10. Between first side wall 12*a*, support surface 14, end wall 12*c* is penetrated by a first insertion opening 15*a*. A second insertion opening 15*b* is provided between second side wall 12*b* and support surface 14 and end way 12*c*. In the area of insertion openings 15*a*, 15*b*, first and second slide pieces 16*a*, 16*b*, respectively, are arranged as mirror images of each other and extend along the sides of support surface 14. Slide pieces 16*a*, 16*b* are mounted in the housing in a manner so that they can slide in the direction perpendicular to end wall 12*c*. Each slide piece has a wedged-shaped bevel B at the ends thereof pointing into the housing 10. Slide pieces 16*a*, 16*b* fill up approximately half of the open area of the insertion openings 15*a*, 15*b* on the side of the opening facing away from support surface 14.

Bordering rear wall 12*d*, first side wall 12*a* is penetrated by a first plug-in opening 17*a*, second side wall 12*b* by a second plug-in opening 17*b*. Rear wall 12*d* is penetrated in the center by a third plug-in opening 18. First side wall 12*a* is penetrated in its central area by a first test opening 19*a*, second side wall 12*b* by a second test opening 19*b*, located in the middle as a mirror image of the first test opening.

Figure 5:
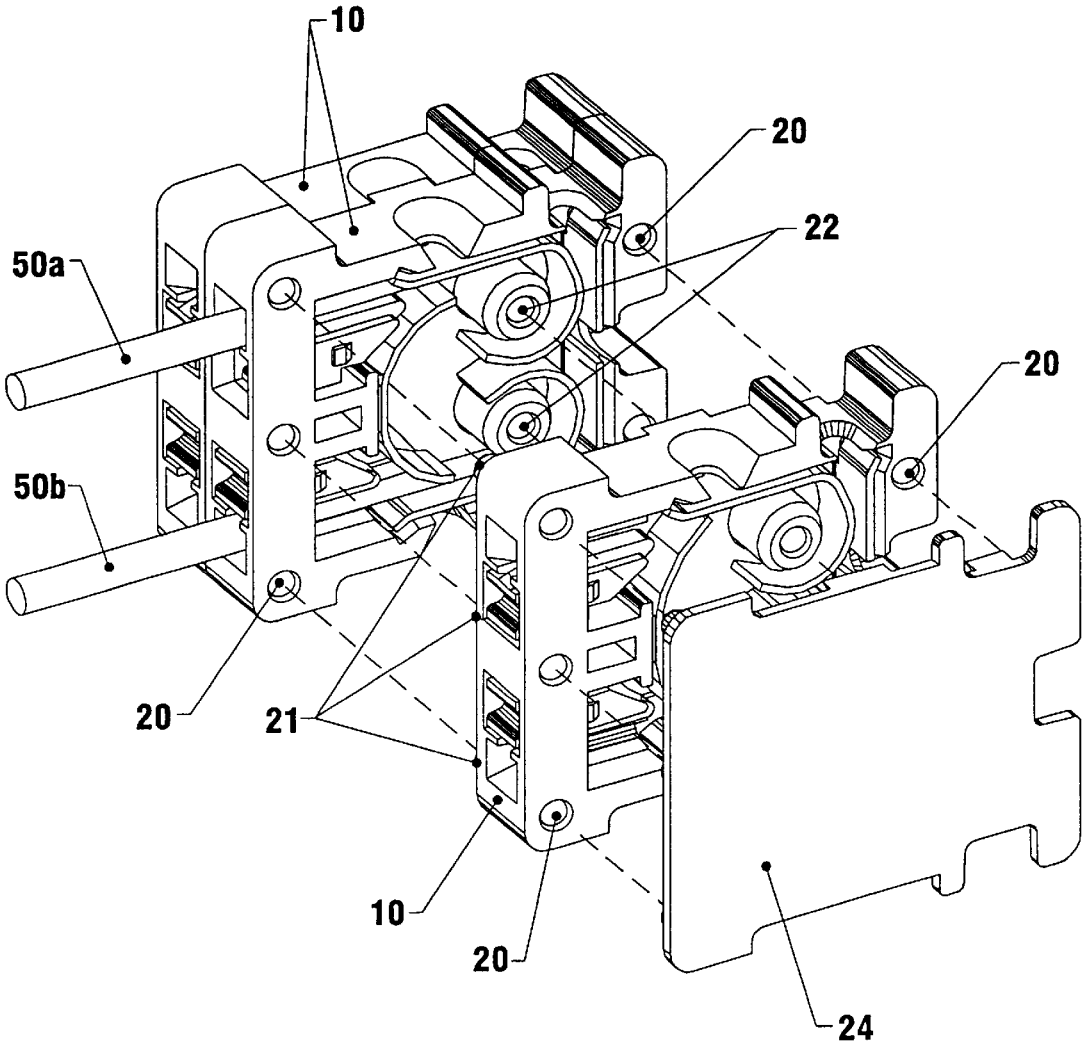
FIG. 5 shows a perspective view of the design of a multi-pin terminal connector assembled from the modules of the first embodiment.

Housings 10 of the individual modules of the terminal connector can be combined as shown in FIG. 5. For this purpose, housing frame 12 has snap-fastener holes 20 in its open side. On the side closed by housing plate 11, housing frame 12 has snap-fastener pegs 21, each of which is aligned to and lines up with a snap-fastener hole 20. In addition, snap-fastener holes 22 are formed in the exposed ends of positioning pegs 12. Snap-fastener pegs 23 are arranged in correspondence with them on the external surface of housing plate 11. When the individual modules are combined to form a multi-pin terminal connector, snap-fastener pegs 21 engage in their assigned snap-fastener holes 20 in housing frame 12, and snap-fastener pegs 23 engage in snap-fastener holes 22 in the positioning pegs, so that the individual housings 10 are locked together.

The open side of the frame of housing 10 is sealed off by housing plate 11 of the neighboring housing 10. The open side of the frame of the last housing 10 is sealed off by a housing cover 24, which has the same shape as housing plate 11 and has correspondingly arranged snap-fastener pegs 21, 23.

Figure 3:
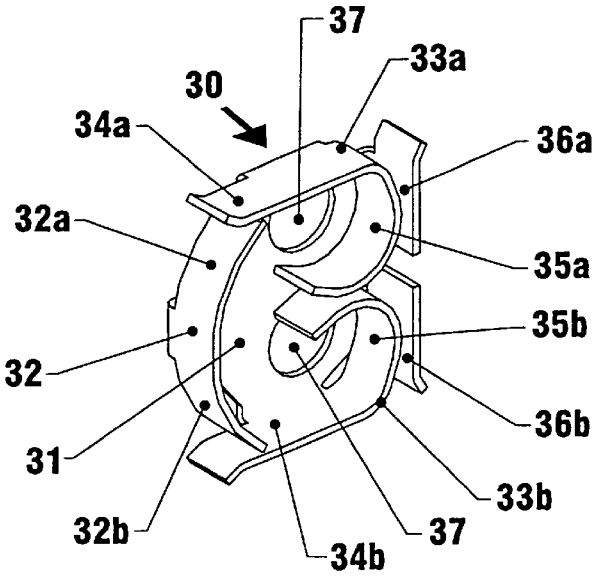
FIG. 3 shows a perspective view of the contact element of the first embodiment.

A contact element 30, shown separately in FIG. 3, is inserted into each housing 10. Contact element 30 is laid loosely in the receptacle cavity of housing 10 and is held in a positive, form-locking manner in housing 10. This positive positioning, which prevents displacement in the plane of housing plate 11, is provided by housing frame 12, support surface 14 and positioning peg 13. In the direction perpendicular to housing plate 11, contact element 30 is held in a positive, form-locking manner between housing plate 11 and housing plate 11 of adjacent housing 10 or housing cover 24.

Figure 4:
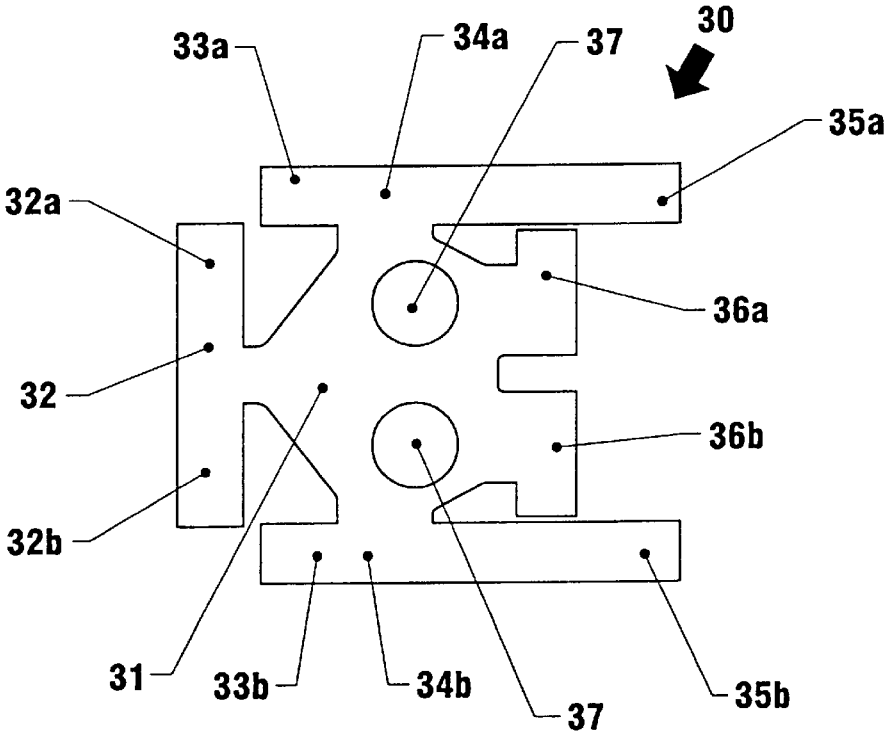
FIG. 4 shows the stamped sheet-metal part, which is bent to form the contact element of FIG. 3.

Contact element 30 may be produced as a cone-piece part, stamped out of sheet metal. For this purpose, a piece of sheet metal is first stamped out as illustrated in FIG. 4. The edges of the stamped metal part are bent upward in certain sections to form the elastic clamped connections and the connecting contacts as illustrated in FIG. 3.

A contact element 30, shown separately in FIG. 3, is inserted into each housing 10. Contact element 30 is laid loosely in the receptacle cavity of the housing 10 and is held in a positive form-locking manner in housing 10. This positive positioning which prevents displacement in the plane of housing plate 11 is provided by housing frame 12, support surface 14 and positioning peg 13. In the direction perpendicular to housing plate 11, contact element 30 is held in a positive, form-locking manner between housing plate 11 and housing plate 11 of adjacent housing 10 or housing cover 24.

Contact element 30 has a base plate 31, around which the edges to be bent up are formed. A clamping spring 32 is formed in the middle of the side edge of base plate 31 facing end wall 12*c*. The clamping spring 32 has a first sidepiece 32*a*, a second sidepiece 32*b*, representing mirror images of each other. When contact element 30 is inserted into housing 10, the area of clamping spring 32 connected to base plate 31 rests against support surface 14 of housing frame 12. Shanks 32*a*, 32*b* project into the area behind insertion openings 15*a*, 15*b*, bending inward from end wall 12*c* into the interior of the housing. Because of the elastic properties of the sheet metal, the free ends of stamped sidepieces 32*a*, 32*b* thus holds the slide pieces in their end position, i.e., pushed against end wall 12*c*.

Contact springs 33*a*, 33*b* are stamped out on the edges of base plate 31 facing side wails 12*a*, 12*b* and then bent up. Each contact spring 33*a*, 33*b* has a support section 34*a*, 34*b* connected to base plate 31, which because of its direct connection to base plate 31, has relatively high rigidity. Following after support sections 35*a*, 35*b* are free, stamped-out compression sections 35*a*, 35*b* which are elastic and extend toward the rear. Compression sections 35*a*, 35*b* are bent inward, as mirror images of each other like snail shells over more than half the circumference of a circle, so that their free ends rest elastically against each other.

Two support surfaces 36*a*, 36*b* are formed next to each other on the edge of base plate 31 facing rear wall 12*d* of housing 10 and are bent up at a right angle from the plane of base plate 31. Support surfaces 36*a*, 36*b* leave a space free in the middle, which after insertion of contact element 30, lines up with third plug-in opening 18 in rear wall 12*d* of housing frame 12. Compression sections 35*a*, 35*b* of contact springs 33*a*, 33*b* rest with elastic force against support surfaces 36*a*, 36*b*.

Finally, base plate 31 has two positioning holes 37 stamped into it through which positioning pegs 13 of housing 10 pass when contact element 30 is inserted into housing 10.

FIG. 1 shows contact element 30 after it has been inserted into housing 10. Positioning pegs 13 are engaged in positioning holes 37 to hold contact element 30 in housing 10 in a positive form-locking manner. Clamping spring 32 rests against support surface 14 of housing frame 12. First contact spring 33*a* rests with its support section 34*a* against the first side wall 12*a*. Second contact spring 33*b* rests with its support section 34*b* against second side wall 12*b*. Free sidepieces 32*a*, 32*b* rest elastically against support sections 34*a*, 34*b* and side walls 12*a*, 12*b*. Support surfaces 36*a*, 36*b* rest against rear wall 12*d*. Free compression sections 35*a*, 35*b* of contact springs 33*a*, 33*b* rest elastically against support sections 34*a*, 34*b* and also rest elastically against each other between positioning pegs 13. The elastic force exerted by compression sections 35*a*, 35*b* against support sections 34*a*, 34*b* is absorbed by these support sections 34*a*, 34*b* and by rear wall 12*d*.

The clamped connections formed by sidepieces 32*a*, 32*b* of clamping springs 32 and support sections 34*a*, 34*b* of contact springs 33*a*, 33*b* serve to connect the conductors. Stripped ends 50*a*, 50*b* of conductors 50 are pushed through insertion openings 15*a*, 15*b*. Conductors 50*a*, 50*b* thus arrive between support sections 34*a*, 34*b* and inward-bent sidepieces 32*a*, 32*b* of clamping spring 32. Shanks 32*a*, 32*b* and 32*b* are pushed by conductors 50*a*, 50*b* away from support sections 34*a*, 34*b* so that conductors 50*a*, 50*b* become clamped between sidepieces 32*a*, 32*b* and support sections 34*a*, 34*b* so that conductors 50*a*, 50*b* become clamped between sidepieces 32*a*, 32*b* and support sections 34*a*, 34*b* and thus held in conductive contact with contact element 30. Conductor 50 cannot be pulled out of the clamped connection or slide free by itself because the edge of the free end of sidepieces 32*a*, 32*b* rests under elastic pressure against the outside surface of conductors 50*a*, 50*b*. When a tensile force is exerted on a conductors 50*a*, 50*b*, the edge of the free end of sidepiece 32*a*, 32*b* digs itself into conductor 50*a*, 50*b* and holds it with a barb-like action. Increasing the tensile force leads to an increase in the clamping effect between sidepieces 32*a*, 32*b* and support sections 34*a*, 34*b*.

Figure 2:
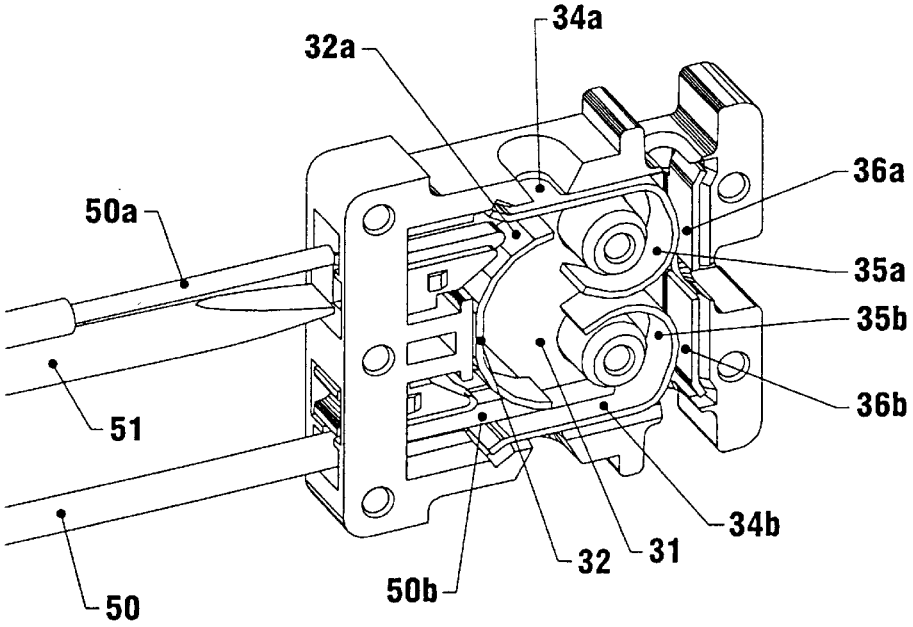
FIG. 2 shows a diagram corresponding to FIG. 1, in which the clamped connection is being released.

When it is desired to release conductor 50 from the clamped connection, a suitable tool, e.g., a screwdriver 51, is used to push the associated slide piece 16*a* inward, as shown in FIG. 2. The wedge-shaped inner end of slide piece 16*a* then presses against bent sidepiece 32*a* of clamping spring 32 and presses this inward away from support section 34*a*, conductor 50*a*. The edge of the free end of sidepiece 32*a* is thus lifted from conductor 50*a* so that the conductors can then be easily pulled out.

Figure 6:
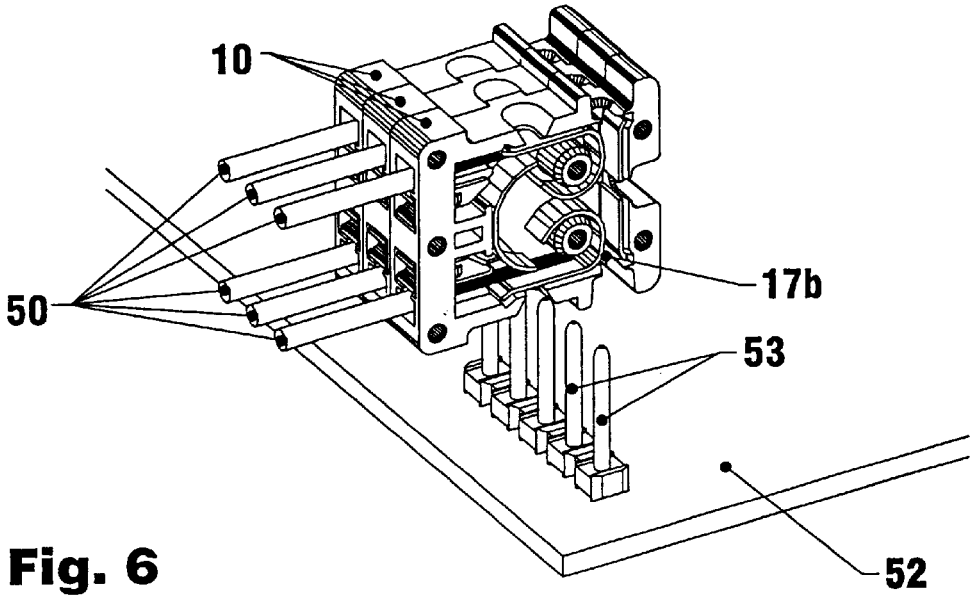
FIG. 6 shows a first way in which the terminal connector of FIG. 5 can be oriented.
Figure 7:
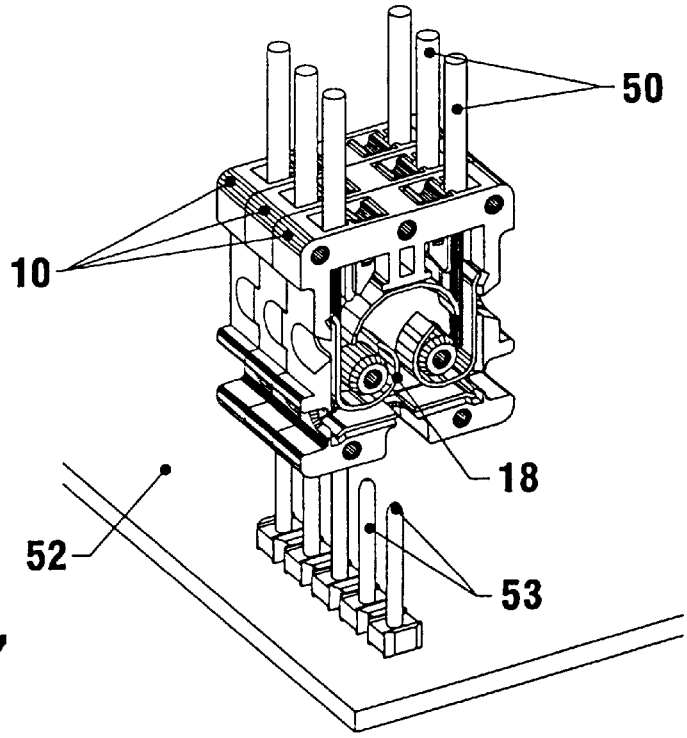
FIG. 7 shows a second way in which the terminal connector of FIG. 5 can be oriented.
Figure 8:
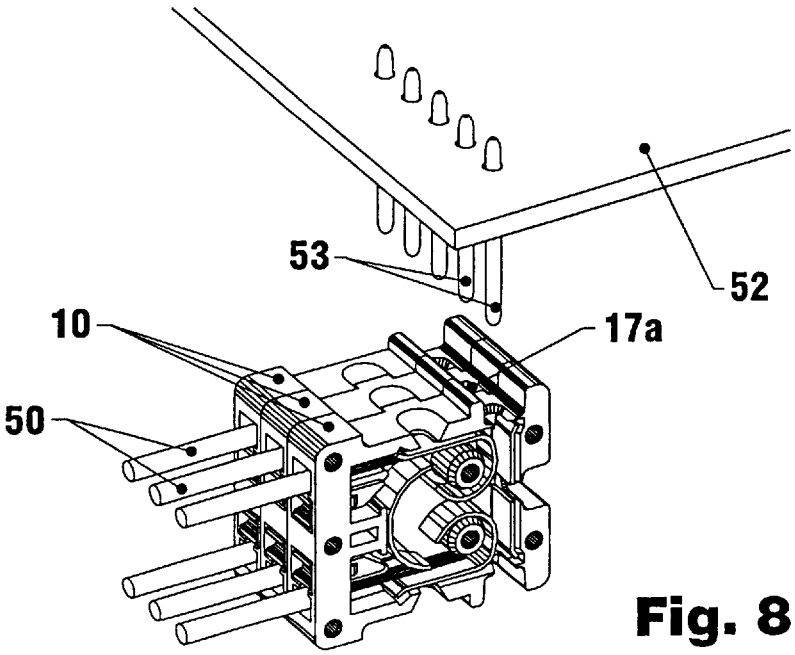
FIG. 8 shows a third way in which the terminal connector of FIG. 5 can be oriented.

FIGS. 6–8 show how the terminal connector can be connected to a device to be connected, i.e., a circuit board 52. For this purpose, circuit board 52 has plug pins 53 which are spaced in a manner corresponding to the spacing between the modules M of the terminal connector. In the illustration of FIG. 6, the terminal connector is set down from above onto circuit board 52, so that plug pins 53 are able to pass through the lower, second, plug-in openings 17*b* and into the connecting contacts, which are formed by compression section 35*b* and second support surfaces 36*b*. The curvature of compression sections 35*b* makes it possible for plug pins 53 to be inserted and pulled out. The elastic property of compression sections 35*b* ensures that a reliable contact will be made between compression sections 35*b* and support surfaces 36*b* and thus with contact element 30. Conductors 50 extend into the terminal connector in a plane parallel to the plane of circuit board 52.

FIG. 7 shows a different orientation of the terminal connector. Here, the terminal connector is mounted on circuit board 52 in such a way that plug pins 53 pass through the third plug-in openings 18 between compression sections 35*a*, 35*b* which are resting against each other. Here also, the curvature of pressure sections 35*a*, 35*b* guarantees that pins 53 can be plugged in easily and also easily removed. The elastic properties of compression sections 35*a*, 35*b* ensure good contact between pins 53 and contact element 30. In this orientation of the terminal connector, conductors 50 can be brought to circuit board 52 in the direction perpendicular to the plane of the board.

FIG. 8, shows an arrangement in which plug-in pins 53 project downward from the circuit board and the terminal connector is correspondingly mounted on plug-in pins 53 by the connecting contacts formed by compression sections 35*a*, support surfaces 36*b*.

Access to support sections 34*a*, 34*b* from the outside is possible through test openings 19*a*, 19*b*. Thus, the tip of a test probe can be passed through a test opening 19*a*, 19*b* to touch contact element 30 to test the voltage at contact element 30 or to tap an electrical signal being carried across the terminal connector.

The exemplary embodiment shown makes it possible to connect two conductors 50*a*, 50*b* to the same connecting pin formed by contact element 30. It is obvious that it is not necessary for two conductors to be connected to the connecting pin. If desired, it is also possible for only one conductors to be connected either to clamped contact 33*a*, 34*b* or to clamped contact 33*b*, 34*b*.

In addition, it is easy to see that the mirror-symmetric design of the upper and lower halves of the exemplary embodiment is not mandatory. The terminal connector can also be designed with only one of these halves. In that case, for example, the connecting contact formed between compression section 35 and support surface 36 can be contacted both via first plug-in opening 17*a*, also via second plug-in opening 17*b*.

Figure 9:
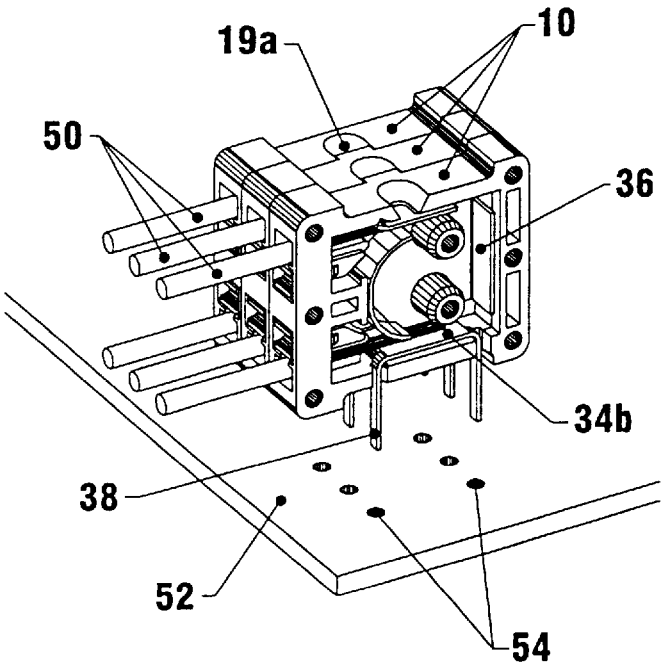
FIG. 9 shows a second embodiment of the terminal connector.

FIG. 9 shows a second exemplary embodiment of the terminal connector.

In this embodiment, first sidepiece 32*a* of clamping spring 32 rests against only one support section 34*a* of first contact spring 33*a*. A compression section 35*a* of contact spring 33*a* is not provided. Second sidepiece 32*b* of clamping spring 32 rests against a support section 34*b* of second contact spring 33*b*, which also has no compression section 35*b*. Terminal pins 38 are formed on support section 34*b* to serve as the connecting contact of the terminal connector. These pins pass through holes in second side wall 12*b* and can be for example inserted into holes 54 in a circuit board 52.

Figure 10:
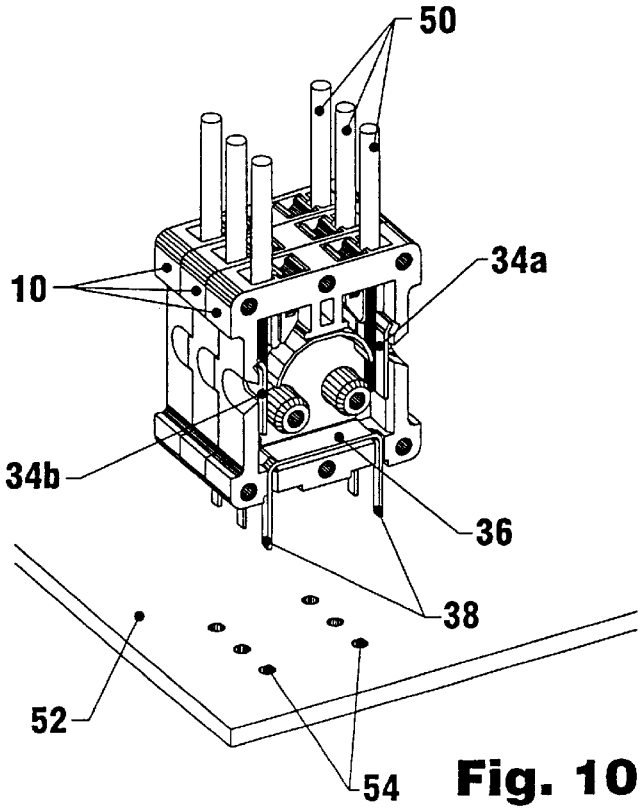
FIG. 10 shows a third embodiment of the terminal connector.

In the exemplary embodiments of FIGS. 9 and 10, the terminal connector is intended to be soldered to a circuit board. According to FIG. 9, conductors 50 extend parallel to the plane of circuit board 52, whereas, according to FIG. 10, they are perpendicular to the plane of circuit board 52. Connecting contacts designed to act as plug receptacles are not provided in these embodiments.

Figure 11:
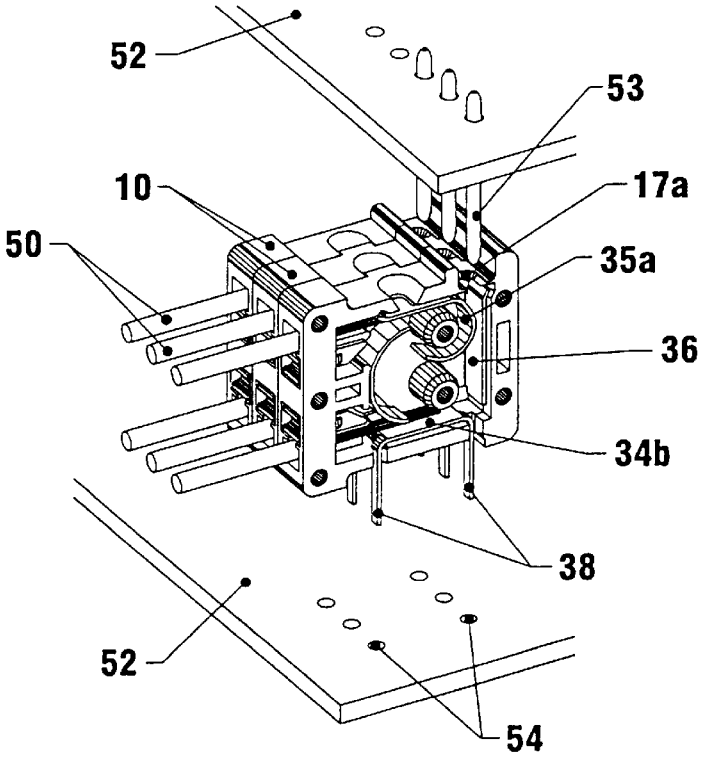
FIG. 11 shows a fourth embodiment of the terminal connector.

FIG. 11 shows and exemplary embodiment in which the connecting contacts act as receptacles for plugs and can also be soldered. First contact spring 33*a* is designed with a compression section 35*a*, which rests elastically against a support surface 36. Thus, a plug-in connecting contact is formed between compression section 35*a*, support surface 36, into plug pins can be inserted. Second contact spring 32*b* is designed with only one support section 34*b*, which is provided by terminal pins 38.

In this embodiment, terminal pins 38 of the terminal connector can be inserted into a first circuit board 52, for example, and soldered to it. A second circuit broad 52 with plug pins can then be plugged from above into plug-in connecting contacts 35*a*, 36. Thus, a sandwich arrangement of circuit boards 52 is possible, where the terminal connectors being about both the mechanical and the electrical connection between the circuit boards.

Even though particular embodiments of the invention have been illustrated and described herein, it is not intended to limit the invention and changes and modifications may be made therein within the scope of the following claims.

What is claimed is:

1. A terminal connector comprising:

a plurality of housing (10) which can be attached to one another in modular fashion to form a multi-pin terminal connector assembly;

a contact element (30), in the housing, said contact element having at least one clamped connection for connecting a conductor (50), and at least one connecting contact formed on the contact element, said contact element (30) being a one-piece member and having edges shaped to form springs (32, 33, 36) for at least one clamped connection and at least one connecting contact; and means mounting the contact element (30) in a positive, form-locking manner in the housing (10).

2. A terminal connector according to claim 1, wherein said housing (10) includes a housing plate (11) and a housing frame (12) extending around its periphery which are molded as a single unit out of plastic and wherein said contact element (30) can be inserted into the cavity formed by the housing plate (11) and the housing frame (12) and housing cover (24) for sealing the open frame side of the housing (10).

3. A terminal connector according to claim 1, wherein said housing (10) includes a housing plate (11) and a housing frame (12) extending around its periphery which are molded as a single unit out of plastic and wherein said contact element (30) can be inserted into the cavity formed by the housing plate (11) and the housing frame (12) and wherein the open frame side of the housing (10) can be sealed off by a housing plate (11) of a second housing (10) attached to an adjacent housing.

4. A terminal connector according to claim 2, wherein said housing cover (24) is attached by means of snap-fastener holes (20, 22) and snap-fastener pegs (21, 23).

5. A terminal connector according to claim 3, wherein the housing plate (11) of one housing is attached to the housing plate (11) of an adjacent housing by means of snap-fastener holes (20, 22) and snap-fastener pegs (21, 23).

6. A terminal connector according to claim 2, wherein at least one clamped connection is formed, on one side, by a free, elastic sidepiece (32*a*, 32*b*) of a clamping spring (32) which is bent up from the contact element (30) and, on the other side, by a support section (34*a*, 34*b*) of a contact spring (33) bent up from the contact element (30), said support section (34*a*, 34*b*) being braced on the inside against the housing frame (12*a*, 12*b*).

7. A terminal connector according to claim 6, characterized in that the sidepieces (32*a*, 32*b*) of a clamping spring (32) which is bent back in the insertion direction of the conductors (5O*a*, 50*b*) to rest against the support section (34*a*, 34*b*) and clamp the inserted conductor (50*a*, 50*b*) with a barb-like action.

8. A terminal connector according to claim 7, including a slide piece (16*a*, 16*b*) is mounted in the housing (10) for each clamped connection actuatable to engage the free sidepiece (32*a*, 32*b*) of the clamping spring (32) thereby to lift said sidepiece (32*a*, 32*b*) away from the support section (34*a*, 34*b*) and to release the clamped conductor (50*a*, 50*b*).

9. A terminal connector according to claim 1, wherein at least one connecting contact is formed on one side by the free, elastic compression section (35*a*, 35*b*) of a contact spring (33), which is bent up from the contact element (30) and on the other side, by a support surface (36, 36*a*, 36*b*) supported against the housing frame (12).

10. A terminal connector according to claim 6, wherein the free elastic compression section (35*a*, 35*b*) of the connecting contact is formed on the support section (34*a*, 34*b*) of the contact spring (33) of the clamped connection.

11. A terminal connector according to claim 1, wherein at least one connecting contact has at least one terminal (38) which is formed on an upwardly bent edge (34*a*, 34*b*, 36) of the contact element (30).

12. A terminal connector according to claim 7, wherein two clamped connections for conductors (50*a*, 50*b*) are provided, and wherein said housing (10) and said contact element (30) are designed with mirror-image symmetry with respect to the clamped connections and the connecting contacts.

13. A terminal connector according to claim 9, wherein the ends of the free compression sections (35*a*, 35*b*) rest against each other with mirror-image symmetry to form a plug-in type connecting contact.

14. A terminal connector according to claim 2, wherein the insertion direction of the conductors (50*a*, 50*b*) into the clamped connections is perpendicular to an end wall (12*c*) of said housing frame (12) and in that the orientation of the connecting contacts in the form of either plug-in contacts or solder contacts, in perpendicular to at least one of the other side wall (12*a*, 12*b*, and 12*d*) of the housing frame (12).

15. A terminal connector comprising:

a plurality of housings (10) which can be attached to one another in modular fashion to form a multi-pin terminal connector assembly;

said housings include a housing plate and a housing frame extending around its periphery which are molded as a single unit out of plastic;

a contact element (30) which can be inserted into the cavity formed by the housing plate and the housing frame, whereby the contact element is mounted in a positive, form-locking manner in the housing, said contact element having a base plate and at least one clamped connection for connecting a conductor, and at least one connecting contact, said contact element having edges bent up from the base plate to form springs (32, 33, 36) for at least one clamped connection and/or at least one connecting contact.

16. A terminal connector comprising:

a housing;

a contact element in said housing having at least one clamped connection for connecting a conductor and at least one connection for connecting a plug-in connector, said contact element being a one piece member and having edges shaped to form springs for at least one clamped connection and/or at least one plug-in connection;

means mounting the contact element in a positive, form-locking manner in the housing;

a plurality of housings which can be attached to one another in modular fashion to form a multi-pin terminal connector assembly;

means for releasing spring pressure of clamped connection allowing removal and replacement of clamped conductor; and means for testing integrity of contact element without disassembly.

* * * * *